United States Patent [19]

Lukacz

[11] Patent Number: 4,494,564

[45] Date of Patent: Jan. 22, 1985

[54] FLAP VALVE

[75] Inventor: Stephen A. Lukacz, Nazareth, Pa.

[73] Assignee: Fuller Company, Bethlehem, Pa.

[21] Appl. No.: 474,368

[22] Filed: Mar. 11, 1983

[51] Int. Cl.[3] ..... F16K 15/03

[52] U.S. Cl. ..... 137/527.6; 137/527.8; 251/308

[58] Field of Search ..... 137/527.4, 527.6, 527.8; 251/308; 236/45

[56] References Cited

U.S. PATENT DOCUMENTS

| | | | |
|---|---|---|---|
| 1,328,565 | 1/1920 | Howard | 251/308 X |
| 4,008,877 | 2/1977 | Yasuoka | 251/308 X |
| 4,057,217 | 11/1977 | MacDonald | 251/308 |
| 4,428,395 | 1/1984 | Bravo | 251/308 |

FOREIGN PATENT DOCUMENTS

| | | | |
|---|---|---|---|
| 2102927 | 7/1972 | France | 137/527.8 |

*Primary Examiner*—Robert G. Nilson
*Attorney, Agent, or Firm*—Frank H. Thomson

[57] ABSTRACT

A flap valve used for selectively closing an open-end of a material conduit. The flap valve is particularly adapted for use in high temperature installations such as at the discharge of a high temperature cyclone separator. The valve includes a shaft rotatably mounted in a fixture properly positioned relative to the conduit to be closed. The shaft includes a polygonal central section and a flap with a top surface adapted to close the open end of the conduit and one end of the flap lies atop the polygonal section of the shaft. The back of the flap is bent perpendicular to the top surface to overhang the shaft. A dog having a similarly shaped polygonal opening slides over the central section of the shaft and has a leg which lies atop the top surface of the flap. This dog serves to transmit rotational forces between the shaft and the flap while allowing relative movement between the shaft on the flap in a direction parallel to the shaft axis to permit relative thermal expansion. A typical counterweight is connected to the shaft to exert a rotational force on the shaft to tend to rotate the flap valve to a closed position. Material in the conduit exerts a force in the flap switch will tend to overcome the force of the counterweight to open the flap.

12 Claims, 6 Drawing Figures

FLAP VALVE

BACKGROUND OF THE INVENTION

The present invention relates to valves in general and in particular a flap valve especially designed for closing an open ended material conduit. The valve is particularly adapted to high temperature installations such as the outlet of a high temperature cyclone separator such as may be used on a suspension preheater of a cement clinker producing facility.

Prior to the present invention, it was generally known to utilize flap valves at the outlet of generally vertical open ended material conduits for controlling the outlet of material from that conduit. These valves include a shaft rotatably mounted in a fixture adjacent the open end of the material conduit and a flag is operatively connected to the shaft. A counterweight exerts a rotational force on the shaft which force is transmitted by suitable means to the flap itself so that the flap is rotated toward the open end of the conduit and thus to a closed position. When material builds up within the conduit so that it has a weight sufficient to overcome the force of the counterweight, the flap will rotate to allow material to spill out of the conduit.

It has been found through experience that a common cause of failure of a flap valve is in the area of the connection of the flap to the rotatably mounted shaft. This is particularly true in high temperature applications. One means for securing the flap to the shaft includes a plurality of taper pins which extend through the shaft and flap. These pins have a tendency to work loose over a period of time with the force being transmitted between the shaft and the flap having a tendency to shear the pin. In high temperature applications, there is usually a difference in the coefficient of thermal expansion of the flap as compared to the shaft. Because the prior art has the flap fixed to the shaft, either the shaft or the flap will have a tendency to warp due to relative thermal expansion between the two parts. Because the taper pins or other means for securing the flap to the shaft put a constraint on the relative movement between the flap and the shaft, a distortion of either the flap or the shaft can occur or the means securing the flap to the shaft will fail.

By the present invention, an apparatus for securing a flap of a flap valve to the valve shaft has been provided which allows a limited relative movement between the flap and the shaft along the axis of the shaft to permit relative thermal expansion while maintaining a positive connection of the flap to the shaft and substantially preventing relative rotational movement between the shaft and the flap. In addition, the present invention allows easy replacement of the flap or the shaft or the bearings mounting the shaft. The connection of the present invention allows most of the parts to be easily manufactured at an economical price. It is particularly advantageous in its ease of assembly and disassembly.

SUMMARY

It is therefore, an object of this invention to provide a novel flap valve which allows easy assembly and maintenance, an eliminates parts from the prior art which have a high failure rate.

It is a further object of this invention to provide a flap valve including a means for connecting the flap to its supporting shaft which allows relative thermal expansion between the shaft and the flap while substantially preventing relative rotational movement between the flap and the shaft.

The foregoing and other objects of this invention will be carried out by providing a flap valve adapted for use in selectively closing an open ended material conduit comprising a shaft adapted to be rotatably mounted in a fixture; a flap having a surface adapted to selectively close a material conduit and having one end engaging said shaft; a dog mounted on said shaft and having a leg lying atop said one end of said flap; said dog being keyed to said shaft whereby when a force is applied to the surface of said flap which selectively closes the conduit, said force is transmitted through said dog to said shaft to rotate said shaft about its own axis to open said material conduit.

BRIEF DESCRIPTION OF THE DRAWINGS

The invention will be described in connection with the annexed drawings wherein.

DESCRIPTION OF THE PREFERRED EMBODIMENT

Figure 1:
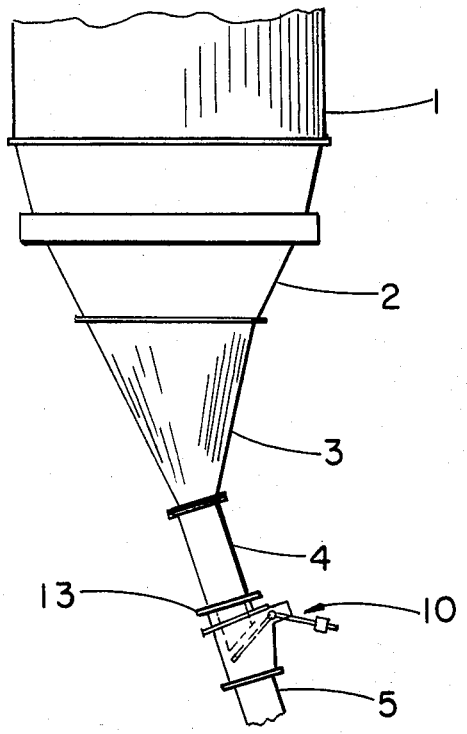
FIG. 1 is a plan view of a portion of a cyclone separator utilizing the flap valve of the present invention.

Referring to the drawings, the flap valve on the present invention is particularly designed for closing an open ended conduit such as the outlet of a cyclone separator used to handle hot material. One such application is in a suspension preheater of a cement manufacturing process. Such a separator is shown in FIG. 1 and includes a top portion which is partially shown at 1 and a conical portion 2 which leads to a transition section 3 and an outlet conduit 4. Gas and suspended particulate material may be supplied tangentially to the top portion 1 through an inlet (not shown). Separated gas is exhausted through at top outlet (not shown) and separated material collects in the conical portion 2 and transition 3 to be discharged through material outlet 4. In order to make the separator properly function, the open ended conduit 4 must be sealed. In order to accomplish this seal, a flap or tipping valve 10 is placed at the outlet of conduit 4. A further conduit 5 is located downstream of conduit 4 and valve 10 to discharge material.

Figure 2:
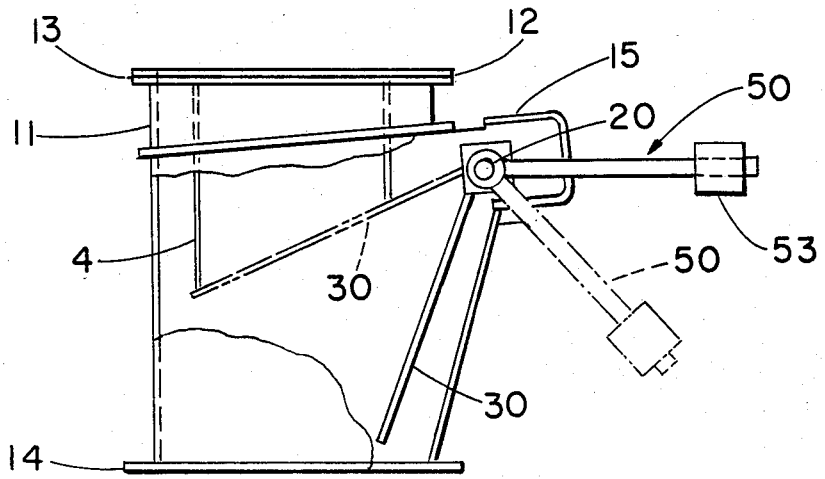
FIG. 2 is a sectional view of an enlarged scale of a portion of FIG. 1.

Referring to FIG. 2, the flap valve 10 of the present invention includes a housing 11 connected by flange 12 to a mating flange 13 of the vessel 1. A bottom flange 14 further defines the housing 11 and is used to connect the conduit 5. The housing also includes an extension 15 which serves as a fixture for holding flap valve 10.

Figure 3:
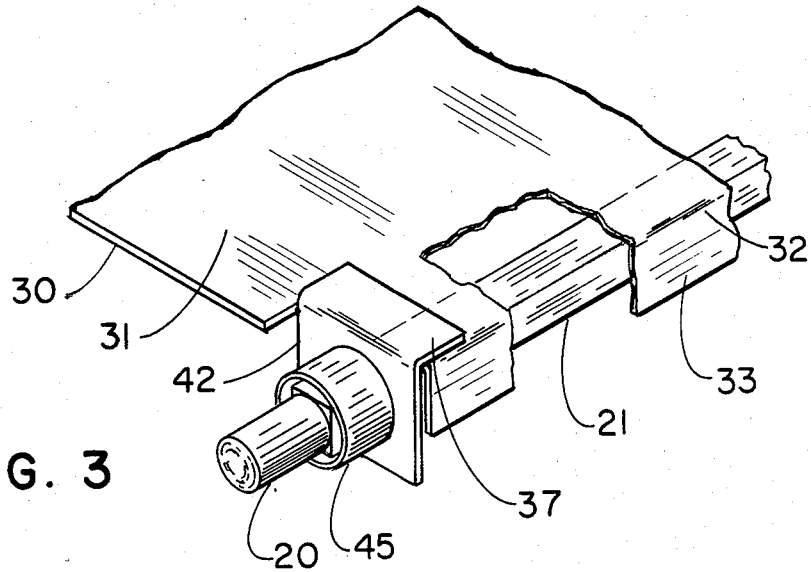
FIG. 3 is a perspective view of a flap valve according to the present invention with a portion of the flap broken away for purposes of clarity.
Figure 5:
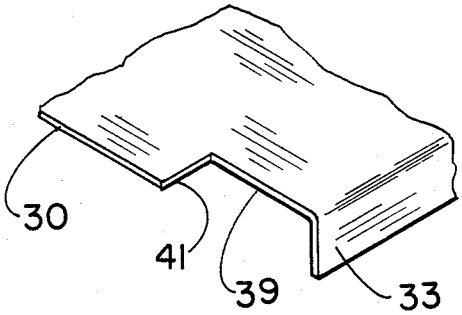
FIG. 5 is a perspective view of a portion of the flap of the present invention.
Figure 6:
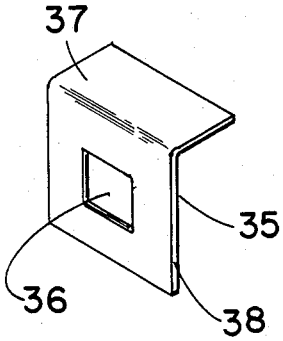
FIG. 6 is a view of a portion of the connecting means or dog of the flap valve.
Figure 4:
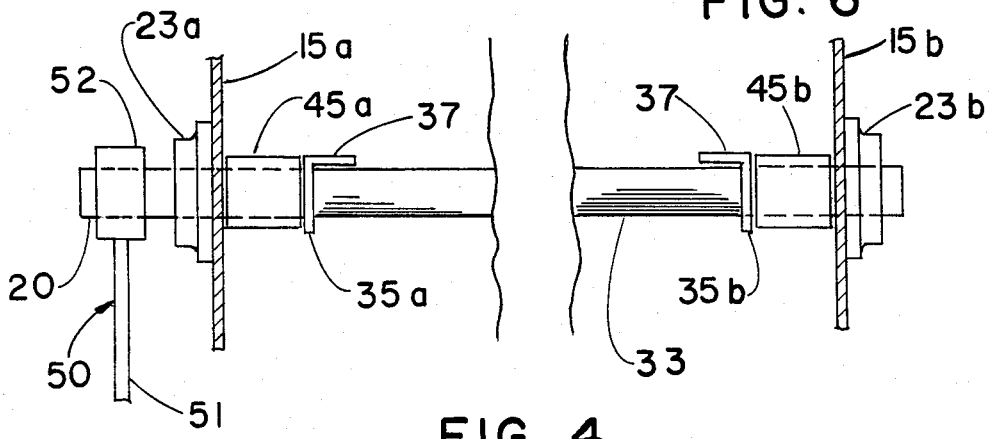
FIG. 4 is an end view of the flap valve of the present invention.

As shown in FIGS. 3 and 4, the shaft 20 includes a polygonal central section 21 which, as illustrated in FIG. 3, is rectangular or square. The shaft is rotatably mounted in a pair of bearings 23*a* and 23*b* suitably fixed to housing extension or fixture 15. With the bearings located outside as shown, they are less exposed to high temperature and easily accessible for maintenance.

The valve 10 also includes a flap 30 which has a top surface 31 or main portion adapted to selectively close the outlet of the open ended conduit 4 as illustrated in FIGS. 1 and 2. The flap includes one end 33 which is bent at 32 perpendicular to the main portion 31 of the flap so that the under surface of the flap 30 at the one end 32 lies atop the polygonal portion 21 of shaft 20 and the main portion 31 and bent portion 33 engage adjacent faces of shaft section 21 as clearly illustrated in FIG. 3. The angled portion 33 rides against the back of the square section 21 to substantially prevent the flap from moving forward relative to the shaft 20. The fit is loose so that relative expansion between shaft 20 and flap 30 does not create an excessive force on either number.

A pair of dogs, each designated by the numeral 35 are utilized for securing the flap 30 to the shaft 20. Each dog includes an opening 36 which is shaped similar to the shape of shaft portion 21, but slightly larger to allow dog 35 to easily slide over shaft portion 21. The leg 37 of dog 35 is generally perpendicular to the other leg 38. As shown in FIGS. 3 and 4 the dog 35 slides over the shaft 20 and the central section 21 so that the leg 37 lies atop the surface 31 of flap 30. The mating opening 36 and polygonal section 21 serve to key the dog 35 to the shaft 20 and together with the legs 37 lying atop flap 30 define a first means for substantially preventing relative rotational movement between the shaft 20 and the flap 30.

The flap 30 also includes a pair of cut out portions 39 each located on one side of the rearward end of the flap. When assembled, each dog 35 fits within one of the cut out portions 39. The shoulder 41 of cut out 39 acting against the forward edge 42 of dog 35 serves to substantially prevent the flap from moving rearwardly on the shaft 20. The bent portion 33 acting against one side of polygonal section 21 combined with the edge 41 of cut outs 39 acting on edge 42 of dogs 35 together define third means for substantially preventing the flap 30 from moving tangentially relative to the shaft 20.

A pair of spacers **45*a* and 45*b* are each mounted on the shaft 20 on opposite sides of the flap 30 to centrally position the flap on shaft 20 between the walls of fixture 15. These spacers 45** may be made from short lengths of suitably dimensioned tubing.

The flap valve 10 also includes a counterweight assembly 50 illustrated in FIGS. 1, 2 and 4 which includes an arm 51 suitably secured at 52 to the shaft 20. A weight 53 of the desired amount is mounted on the remote end of the arm 51 and may be adjusted in a manner well-known in the art as by adding more weight or by moving the position of the weight relative to the end of the shaft.

In order to assemble the valve 10, the shaft 20 is fitted through an opening in one of the walls such as the wall at the left side of FIG. 4. A spacer **45*a* is slid over the end of the shaft which has passed through the opening in wall 15. Next, a pair of dogs 35*a* and 35*b* are slid onto shaft 21 with the leg 37 of dog 35*a* as illustrated in FIG. 4 facing the leg 37 of dog 35*b*. The dogs 35*a* and 35*b* are spread apart and the flap 30 is then placed over the shaft 20 to lie atop the top surface of central section 21 between the two dogs 35*a* and 35*b*. Next, a second spacer 45*b* is placed over the shaft 20 and the end of the shaft is pushed through a suitable opening in the righthand wall of the fixture 15. The bearings 23*a* and 23*b* can then be attached to the shaft 21 and the outside walls of fixture 15. The counterweight assembly 50 may be attached to the shaft 20 either before or after assembly into the fixture 15**.

The flap 34 dogs 35 and spacers 45 are dimensioned to allow a loose fit of these parts between the walls **15*a* and 15*b* which make up the fixture for rotatably mounting shaft 20. This loose fit together with the fact that all parts slide easily over shaft 20 so that the dogs 35 slide over central section 21 define a second means for permitting relative movement between the flap 30 and shaft 20 in a direction along the axis of rotation of the shaft 20**.

The flap valve operates in a manner known to those skilled in the art. Referring to FIG. 2, the counterweight assembly 50 exerts a force on the shaft 20 which rotational force is transmitted through shaft 21 and in particular the keyed connection of polygonal opening 36 in dog 35 so that rotational force is transmitted to flap 30 whereby the flap is rotated upwardly until it engages the bottom of the conduit 4 to thereby close and seal that conduit. As material builds up in transition section 3 and conduit 4, the weight of that material exerts a downward force on the flap 30. This force is transmitted through dog 35 to shaft 20 to tend to overcome the force of the counterweight assembly 50. When sufficient material builds up in conduit 4, the force of the material overcomes the counterweight and the flap 30 and shaft 20 will rotate as a unit relative to fixture 15 so that flap 30 will swing open to the position shown in solid lines in FIG. 2 and material is dumped from the conduit 4 and separator 1. Once material has dumped from the conduit 4, the counterweight again exerts a rotational force on shaft 20 and flap 30 and the flap promptly swings back to the position shown by dotted lines to again close and preferably seal the conduit 4.

In a hot cyclone application, the entire area around outlet conduit 4 is at a high temperature which means that the shaft 20 and flap 30 are exposed to high temperature. Because of the variations in the sizes of the various pieces and the material used for those pieces having differing coefficients of thermal expansion, a differential expansion can be encountered between the flap 30 and shaft 20. With the prior practice of using some means such as pins to fix a flap to the rotatably mounted shaft, the differential expansion of the various parts results in forces being applied to the various parts which causes fasteners to fail, flaps to bend and other damage to parts. Because the present invention allows float between the shaft and the flap in the direction of the axis of rotation of the shaft and the dogs are allowed to slide on sahft 20, a differential expansion between the various parts will not result in fastener failure or flap buckling. For this purpose, it is important that the fit between fixture 15 and flap 30 be loose and, therefore, the spacers 45 are not made to a close tolerance relative to the distance between the fixture 15 and the dog 35. It should be noted that the relative movement between the shaft and the flap along the axis of the shaft must be limited to that which is reasonably necessary to compensate for thermal expansion. The various parts are dimensioned to allow compensation for temperature change, yet must limit relative movement to ensure a proper seal of the open ended conduit. For this purpose, spacers 45 are to be dimensioned to centrally position flap 30 yet allow some limited relative movement of the flap.

From the foregoing, it should be apparant that the objects of the present invention have been carried out. A simple means is utilized for connecting the flap of a flap valve to the operating shaft which permits easy assembly and disassembly without the use of complex tools. It allows easy replacement of the shaft or the flap in the event of wear. The valve can be used in high temperature applications because the design allows differential expansions of the various parts. The various parts are simple fabrications. While it is preferable that two dogs 35 be utilized, each positioned on opposite sides of the flap, there may be some installation where a single dog is desireable. The invention is intended to apply to such applications.

It is intended that the foregoing be a description of the preferred embodiment and that the invention be limited solely by that which is within the scope of the appended claims.

I claim:

1. A flap valve adapted for use in selectively closing an open ended material conduit comprising:

a shaft adapted to be rotatably mounted in a fixture;

a flap having a surface adapted to selectively close a material conduit and having one end engaging said shaft;

a dog mounted on said shaft and having a leg lying atop said one end of said flap;

said dog being keyed to said shaft whereby when a force is applied to the surface of said flap which selectively closes the conduit, said force is transmitted through said dog to said shaft to tend to rotate said shaft about its own axis to open said material conduit;

said one end of said flap being bent at an angle to the surface which selectively closes the conduit for preventing said flap from moving in one direction relative to said shaft; and spacer means positioned between said dog and said fixture.

2. A flap valve according to claim 1 wherein said shaft has at least one polygonal portion and said dog as has an opening there through which is shaped similar to the polygonal portion of said shaft to thereby define a means for keying said dog to said shaft.

3. A flap valve according to claim 2 wherein there are a pair of dogs each removably mounted in spaced apart relationship on said shaft and each adapted to engage opposite sides of the flap.

4. A flap valve according to claim 3 wherein there are a pair of spacer means, each positioned between one of said dogs and said fixture for centrally positioning said flap, on said shaft.

5. A flap valve according to claim 4 wherein said shaft has a rectangular section in the central part thereof and each of said dogs has a similarly shaped opening therethrough which enables said dogs to fit over said central part of said shaft to thereby define a means for keying said shaft to said shaft.

6. A flap valve according to claim 5 wherein said one end of said flap has a bent portion perpendicular to a main portion of the flap and the bent portion and main portion engage adjacent faces of the rectangular section of the shaft for preventing said flap from moving in one direction relative to said shaft.

7. A flap valve according to claim 6 wherein said flap has a pair of cut outs on opposite edges thereof adjacent said one end, each adapted to receive one of said dogs, whereby the corner of each of said cut outs engages its associated dog to prevent said flap from moving rearwardly relative to said shaft.

8. A flap valve adapted for use in selectively closing an open ended material conduit comprising a shaft adapted to be rotatably mounted in a fixture; a flap having a surface adapted to selectively close a material conduit and having one end engaging said shaft; a pair of dogs, each mounted on said shaft and having a leg lying atop said one end of said flap; said dogs being keyed to said shaft whereby when a force is applied to the surface of said flap which selectively closes the conduit, said force is transmitted through said dogs to said shaft to tend to rotate said shaft about its own axis to open said material conduit; said shaft having at least one rectangular portion and each dog has a similarly shaped rectangular opening therethrough to define a means for keying said dog to said shaft, said one end of said flap valve lies atop one surface of the rectangular portion of the shaft and has a portion bent perpendicular to said surface to engage an adjacent face of said shaft, and each of said dogs is adopted to engage opposite edges of said flap.

9. In a flap valve for use in selectively closing the open end of a bulk material handling conduit which includes a shaft rotatably mounted in a fixture, a flap operatively connected to said shaft and positioned to selectively close the bulk material conduit, and a counterweight operatively connected to said shaft for exerting a torque on said shaft for rotating said shaft and said flap to a position which closes the conduit whereby material in said conduit exerts a force on said flap in a direction opposite to the force exerted by said counterweight the improvement comprising means for securing the flap to the shaft which includes said shaft having a polygonal shaped central section, a pair of dogs, each having an opening therethrough shaped similar to the polygonal shaped central section of said shaft, each of said dogs being slidably mounted on the central section of said shaft and having a leg lying atop said flap, whereby the polygonal central section of the shaft, similarly shaped opening in said dogs and the legs of said dogs lying atop said flap define means for substantially preventing relative rotational movement between said shaft and said flap, while substantially permitting relative movement between said shaft and said flap in the direction of the axis of rotation of said shaft.

10. In a flap valve according to claim 9 the improvement further comprising further means for substantially preventing said flap from moving tangentially relative to said shaft including said flap having a portion bent over said shaft and a pair of cut-outs each located on opposite sides of said flap adjacent said shaft and each of said dogs fits into one of said cut-outs.

11. A flap valve adapted for use in selectively closing a conduit comprising:

a shaft adapted to be rotatably mounted in a fixture;

a flap adapted to selectively close a conduit and operatively associated with said shaft;

a pair of dogs removably mounted in spaced apart relationship on said shaft, each having a leg lying atop said flap and each adapted to engage opposite sides of the flap;

each of said dogs being keyed to said shaft whereby rotational force is transmitted between said shaft and said flap through said dogs whereby said flap and said shaft may rotate together about the axis of the shaft.

12. A flap valve according to claim 11 wherein said flap has a pair of cutouts on opposite edges thereof, each adapted to receive one of said dogs whereby the corner of each of said cut outs engages its associated dog.

* * * * *